US007721880B2

(12) United States Patent
Pearce et al.

(10) Patent No.: US 7,721,880 B2
(45) Date of Patent: May 25, 2010

(54) MIXING DISPENSER

(75) Inventors: Alisdair Gilbert Pearce, Putaruru (NZ); Jeffrey John Sharp, Hamilton (NZ); Adam David Hester, Hamilton (NZ)

(73) Assignee: SJI Limited, Tauranga (NZ)

( * ) Notice: Subject to any disclaimer, the term of this patent is extended or adjusted under 35 U.S.C. 154(b) by 665 days.

(21) Appl. No.: 10/541,410

(22) PCT Filed: Dec. 24, 2003

(86) PCT No.: PCT/NZ03/00295

§ 371 (c)(1),
(2), (4) Date: Jul. 10, 2006

(87) PCT Pub. No.: WO2004/060766

PCT Pub. Date: Jul. 22, 2004

(65) Prior Publication Data

US 2006/0254935 A1 Nov. 16, 2006

(30) Foreign Application Priority Data

Jan. 3, 2003 (NZ) ..... 523406
Jun. 30, 2003 (NZ) ..... 526774

(51) Int. Cl.
*B65D 25/08* (2006.01)

(52) U.S. Cl. ..... 206/219; 206/568; 215/DIG. 8

(58) Field of Classification Search ..... 206/219, 206/221, 568; 215/DIG. 8
See application file for complete search history.

(56) References Cited

U.S. PATENT DOCUMENTS 3,156,369 A * 11/1964 Bowes et. al. ..... 206/222
4,591,050 A * 5/1986 Finke et al. ..... 206/222
5,647,481 A * 7/1997 Hundertmark et al. ..... 206/219
5,884,759 A * 3/1999 Gueret ..... 206/222
5,908,107 A * 6/1999 Baudin ..... 206/221
6,244,433 B1 * 6/2001 Vieu ..... 206/221

(Continued)

FOREIGN PATENT DOCUMENTS

JP 2001-062357 A 3/2001

(Continued)

OTHER PUBLICATIONS

International Search Report mailed May 3, 2004, for International Application No. PCT/NZ 03/00295.

*Primary Examiner*—Mickey Yu
*Assistant Examiner*—Jenine M Pagan
(74) *Attorney, Agent, or Firm*—Lowe Hauptman Ham & Berner LLP

(57) ABSTRACT

A dispenser comprises a container having a first aperture therein and a first closure element for sealingly closing the first aperture wherein the container has a second aperture and a second closure element for closing said second aperture, the second closure element including a pressing element operable to press inwardly towards the second aperture, a blister pack, locating element locating the blister pack to span across the second aperture and sealing element sufficient to ensure the second aperture is sealingly closable against leakage of the intended contents of the dispenser. The construction and arrangement is such that in end use the container holds a first substance and the blister pack holds a second substance and when the pressing element is pushed the blister pack is ruptured enabling the mixing of the contents thereof with those of the container.

26 Claims, 1 Drawing Sheet

U.S. PATENT DOCUMENTS

| | | | | |
|---|---|---|---|---|
| 2001/0004054 | A1* | 6/2001 | Mollstam et al. | 206/222 |
| 2002/0179461 | A1* | 12/2002 | Mollstam et al. | 206/222 |

FOREIGN PATENT DOCUMENTS

| | | |
|---|---|---|
| WO | 93/14990 | 8/1993 |
| WO | 98/00348 | 1/1998 |
| WO | 98/40289 | 9/1998 |
| WO | 00/26107 | 5/2000 |
| WO | 00/27717 | 5/2000 |

* cited by examiner

MIXING DISPENSER

RELATED APPLICATIONS

The present application is based on International Application No. PCT/NZ2003/000295 filed Dec. 24, 2003, and claims priority from New Zealand Application Numbers 523406 and 526774 filed Jan. 3, 2003 and Jun. 30, 2003, the disclosures of which are hereby incorporated by reference herein in its entirety.

TECHNICAL FIELD

This invention relates to a dispenser in the form of an additive releasing container. The additive releasing container may be a bottle which provides a means for separately retaining a fluid and an additive (possibly in the form of a tablet such as a vitamin tablet or pharmaceutical preparation) and also a means for releasing the tablet into the fluid held in the bottle. The additive releasing bottle would include a means to enable the combined fluid and additive to be removed from the bottle, perhaps a little at a time with the bottle being resealed between dispensed amounts. The container might alternatively be used to dispense a powder into a powder. The actual substances to be mixed are not limited to just the above examples, however.

BACKGROUND ART

When the dispenser is in the form of a liquid containing bottle, bottle caps, designed to retain an additive such as a powder or tablet or liquid and to subsequently release the additive into an attached bottle upon manipulation by a user, are known in the pharmaceutical industry and more recently in the sports drinks industry. Examples of such discharge caps are disclosed in WO98/40289, WO00/27717, WO98/00348 and WO93/14990. Many of the prior art mechanisms are cumbersome and their size can cause difficulties in the packaging, transportation and display of bottles. Their bulk may also detract from the appearance of the product which is of importance in relation to certain products such as sports drinks. Others may be complex and difficult or costly to manufacture.

DISCLOSURE OF THE INVENTION

The invention resides in a dispenser comprising:

a container having a first aperture therein and
- a first closure means for sealingly closing the first aperture characterised in that the container has:
  - a second aperture,
- and a second closure means for closing said second aperture,
- said second closure means including:
  - a pressing means operable to press inwardly towards said second aperture,
  - a blister pack,
  - locating means locating said blister pack to span across said second aperture,
  - sealing means sufficient to ensure the second aperture is sealingly closable against leakage of the intended contents of the dispenser, the construction and arrangement being such that in end use the container holds a first substance and the blister pack holds a second substance and when the pressing means is pushed the blister pack is ruptured enabling the mixing of the contents thereof with those of the container.

Preferably only a peripheral annulus of the blister pack is engaged by said locating means and the blister pack, in conjunction with said sealing means sealingly closes directly against the periphery of said second aperture whether the blister pack is ruptured or not.

Alternatively the blister pack is held by said locating means in a suitable position within said second closure means to span across said second aperture but not to effect sealing closure of it and other parts of said second closure means acting in conjunction with said sealing means sealingly close the second aperture.

Preferably the second aperture is at the base of the container.

Preferably the pressing means is in the form of a flexible diaphragm which is an integral part of the second closure means.

Preferably the second closure means includes security means preventing the second closure means from being removed from said container once fully fitted.

Preferably said second closure means is able to be partially fitted to said container in a manner enabling its subsequent removal to allow a blister pack to be added prior to fully fitting the said second closure means and prior to inserting the requisite substance into said container.

Alternatively said second closure means may removably and sealingly close said second aperture even when partially fitted thus allowing the requisite substance to be inserted in said container prior to the placement of said blister pack.

Preferably the second closure means is substantially in the form of a cup adapted to form the base of the dispenser and to shield said pressing means from inadvertent pressing, at least under the weight of the dispenser.

Preferably said second closure means has a cylindrical skirt with a female thread adapted to mate with a corresponding male thread on a cylindrical wall forming part of the base of said container.

Preferably said cylindrical skirt and cylindrical wall have mateable saw teeth so that when threaded sufficiently together the respective teeth progressively mutually engage and prevent counter-rotation.

Alternatively or additionally the skirt and wall are welded or glued together.

Preferably the blister pack contains a solid tablet.

Preferably only the side of the blister pack facing inwards is rupturable and the other side is flexible but not able to be ruptured by operation of the pressing means.

Preferably the inner facing side is a metal foil.

Preferably the sealing means is an annulus of compressible sealing material.

The second closure and container may be marketed empty and separately from the additive blister packs which might be user installed.

One or both of the second closure and container might be reusable to some extent. Or the additive blister might be installed prior to sale which would be the case if the contents to be held in the container were not easily available to the end user, or for user convenience. Once the blister pack is installed, however, the arrangement usually desired is that the second closure becomes no longer removable from the container. This can be achieved by the use of one-way thread engagement or by ultrasonic welding etc.

The container and first and second closure and blister might be heatable or coolable if required.

DESCRIPTION OF DRAWING

The drawing shows a partial central longitudinal cross-sectional view of one type of dispenser according to the present invention in the form of a cylindrical bottle-shaped container, the base of which is provided by the second closure means which is shown in place with a blister pack installed (the blister pack not being cross-sectioned).

PREFERRED MODE

Figure 1:
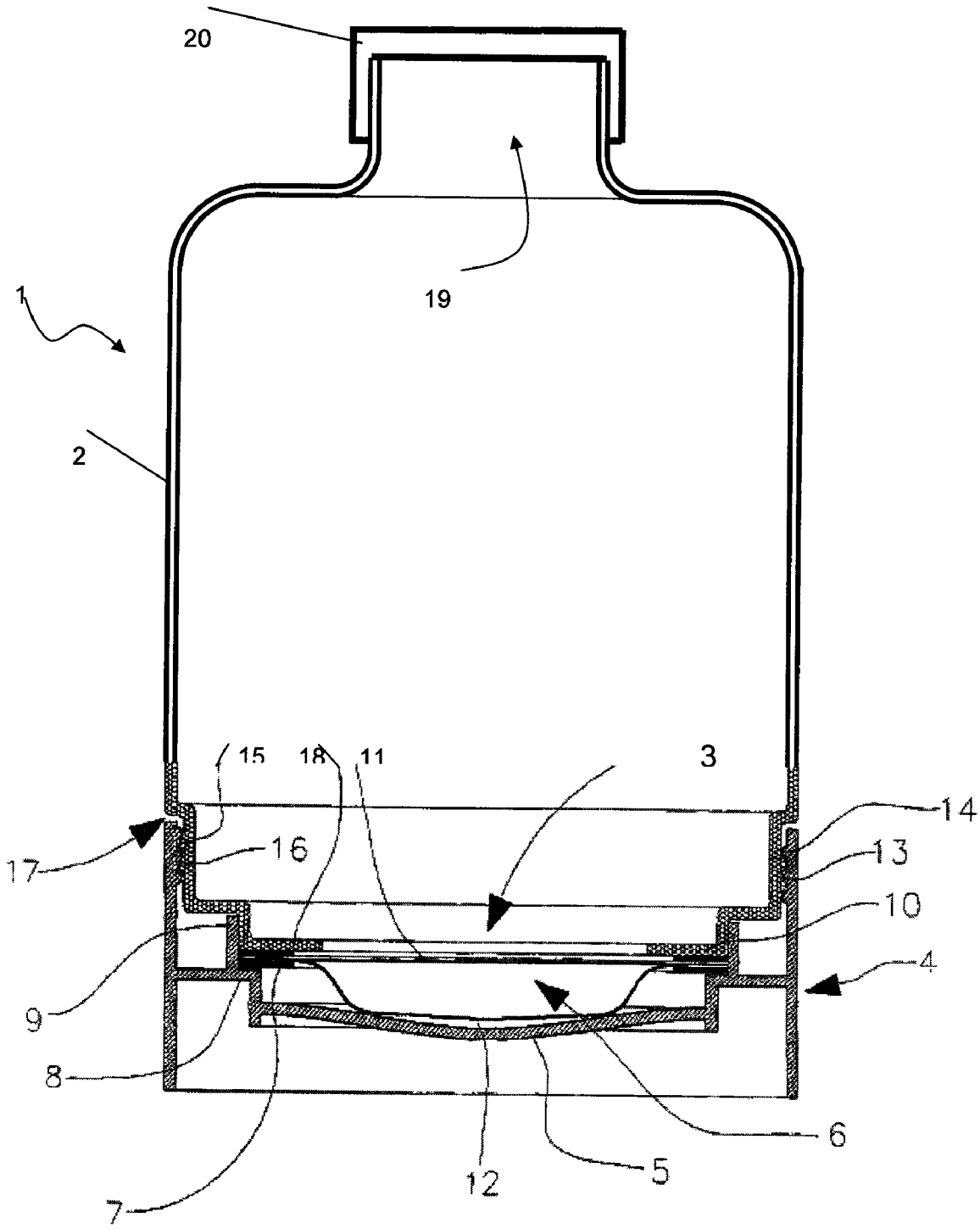

The dispenser such as 1 may be provided with a container such as 2 in any shape for example, spherical or cuboidal. The container would have a first aperture 19 therein and a first closure means 20 for sealingly closing the first aperture, said first closure means being openable to enable the contents of the container to be dispensed therefrom in use. Such a description encompasses most types of dispenser in various shapes.

The characteristic of the dispenser of this invention, however, is that the container has a second aperture such as 3 in FIG. 1. The second aperture may be located at any convenient place on the container, e.g. on the side wall, but for many uses the appropriate position is at the base with the aperture facing downwards.

A second closure means 4 is provided for closing the second aperture 3.

The second closure means includes a pressing means 5 operable to press inwardly towards the second aperture 3, a blister pack 6 and locating means locating the blister pack to span across the second aperture 3.

The locating means in FIG. 1 comprise the shoulder 8 on which an annular seal 7 rests and upon which in turn rests the blister pack, and the internal skirt 9. There is an additional annular sealing ring 10 and the sandwich of the sealing rings 7 and 10 and the blister pack 6 are in practice compressed between the shoulder 8 and the periphery 18 of the second aperture 3. FIG. 1 shows the assembly uncompressed for clarity of illustration. The annular sealing means are in some circumstances optional. One of them might be omitted or both might be omitted in a circumstance where the contents of the container would be at no risk of leakage out of the container because of their nature, a sufficient sealing means being provided by other parts of the second closure means, as will be described. For example, the container may contain just a powder rather than a liquid and a rapid sealing may not be necessary.

In the arrangement just described, the blister pack is described spanning across the second aperture 3 and also sealing across the second aperture. However the location means might simply hold the blister pack in a similar position but without there being any sealing across the second aperture 3 effected at all so that at all times the blister pack would be immersed in the contents of the container but would still be held in an appropriate position to be ruptured.

Rupturing is effected by pushing the pressing means 5 inwardly towards the second aperture. The blister pack is preferably provided with only one side rupturable, that being the side 11 facing inwards towards the second aperture 3 and that side is preferably a metal foil such as a thin aluminium foil. The opposite side 12 is preferably a flexible plastics material.

The blister pack is suitably formed in a shape having regard to its contents such that pressure exerted through the pressing means 5 will be transmitted through the side 12 and through the contents of the blister pack to cause rupturing of the side 11 and release of the blister pack contents into the container. The easiest way to ensure the release of the blister pack contents is to compress them into a tablet where release in that form would be satisfactory for the purposes of the dispenser.

Preferably the pressing means 5 is integrally formed as a flexible diaphragm portion of the second closure means. However, there could be a separate part perhaps snap fitted into place or screwed into place and a suitable construction is illustrated in the first filed application (No. 523406) from which priority is claimed for this invention. The integral construction however has obvious advantages, especially if the blister pack 6 itself is not to form the seal across the second aperture 3. Where the blister pack is such that, whether ruptured or not, it, in conjunction with the sealing means annular rings 7 and 10, always maintains a sealing closure across the second aperture, then the other components of the second closure means merely have to hold the blister pack in secure sealing engagement with the container and do not themselves need to effect the seal across the second aperture.

Because of the possible uses of the container according to the present invention, it might be appropriate in some circumstances to ensure that the second sealing means was able to be partially or fully fitted to the container. For example, there might be an application where it was undesirable to fit the blister pack and contents until immediately prior to the requisite mixing of the contents of the container. In such a situation, the second closure means may be required to be partially fitted without the blister pack to effect an adequate seal, e.g. by annular sealing rings 7 and 10 with the container, which would be inverted when the blister pack was to be added, the second closure means removed, the blister pack inserted with the seals suitably placed, and then the second closure means fully fitted to the container.

In a case where the second closure means was in the form of a cup, as illustrated, with the cylindrical skirt 13, projecting downwardly sufficiently to shield the pressing means 5 from inadvertent pressing, the skirt might have a female thread 14 which mated with a corresponding male thread 15 on a cylindrical wall 16 forming part of the base of the container 2. Partial fitting may be assisted by careful control of the height of the inner skirt 9 in conjunction with the thickness of the sealing rings 7 and 10 so that they were not overcompressed during a partial fitting, but subsequently, when full fitting was required, further rotation of the second closure means 4 with respect to the container 2 would enable the skirt 9 to be deformed somewhat and mateable ramped teeth (not shown) provided at 17 in the top edge of the second closure means and a downwards-facing part of the container wall 16 would progressively mutually engage and prevent counter-rotation. The first closure means might be similarly provided where such security was necessary. Then rupturing of the blister pack which might result in a poisonous mixture, could take place at a time and location where the used dispenser could be safely disposed of, while the results of mixing the two substances could be observed. The sort of usages envisaged in an application like that might be chemical or medical tests.

In another application, the blister pack might be fitted initially when the dispenser was sold and to ensure that it was not removed from the container the second closure means might even be welded or glued to the container when fully fitted.

In another application, the dispenser might be intended to be re-usable and might be provided with or without any installed blister pack, but the user could install a blister pack of choice prior to filling the container with, say, water. The blister pack might contain some form of dietary supplement mixable with water but which should only be mixed immediately prior to use.

In yet another application, the dispenser might be provided with another closure means identical to the second closure means for closing a different aperture in the container. That aperture might be the first aperture and thus it might be possible to have a bottle, say, with a liquid in it, into which two different substances could be released into the liquid simultaneously or one after the other by utilising the present invention. Obviously, that concept could be extended to any number of apertures and closures.

The essential advantage of the present invention is the very simple means by which provision is made for the separation of two substances and their subsequent mixing within the dispenser.

The arrangement allows the use of a simple first closure means for the first aperture, such as a standard sipper top. The complications inherent in the closures discussed in the background section of this specification are entirely avoided.

The term "blister pack" is intended to cover any type of envelope sandwiching a substance between two layers.

| Reference | Description |
|---|---|
| 1 | Dispenser |
| 2 | Container |
| 3 | Second aperture |
| 4 | Second closure means |
| 5 | Pressing means |
| 6 | Blister pack |
| 7 | Annular seal |
| 8 | Shoulder |
| 9 | Internal skirt |
| 10 | Annular sealing ring |
| 11 | Rupturable side of 6 |
| 12 | Flexible plastics side of 6 |
| 13 | Skirt |
| 14 | Female thread |
| 15 | Male thread |
| 16 | Cylindrical wall |
| 17 | Ramps area |
| 18 | Periphery of 3 |

The invention claimed is:

1. A closure element for a dispenser, the closure element configured to sealingly close an aperture in a container of the dispenser, the closure element comprising:

an outer skirt configured to enable the closure element to attach to the aperture of the container;

a flexible membrane; and a locating element comprising:

a shoulder having an edge separating two substantially orthogonal shoulder elements, wherein a first shoulder element is connected to the flexible membrane and the second shoulder element is connected to the outer skirt; and an inner skirt extending from the second shoulder element and spaced a distance from the edge, wherein the shoulder and inner skirt form an annular bounded ledge extending between the inner skirt and the edge of the shoulder on which a seal can rest so as to span the space formed by the second shoulder element and the flexible membrane, and wherein the flexible membrane is formed as a single piece with the closure element.

2. A closure element as claimed in claim 1 including a seal configured to span the space formed by the second shoulder element and the flexible membrane.

3. A closure element as claimed in claim 2 wherein, in use with the closure element attached to the container, the seal is configured to span across the aperture of the container.

4. A closure element as claimed in claim 2 wherein the seal is a metal foil.

5. A closure element as claimed in claim 4 wherein the metal foil forms a side of a blister pack.

6. A closure element as claimed in claim 1 including a sealing element sufficient to ensure that, in use with the closure element attached to the container, the aperture is sealingly closable against leakage of the intended contents of the container.

7. A closure element as claimed in claim 6 wherein the sealing element is an annulus of compressible sealing material.

8. A container configured to cooperate with a closure element as claimed in claim 1.

9. A dispenser comprising:

a container having a first aperture therein and a first closure element for sealingly closing the first aperture; and a second aperture formed by a wall forming part of the container and configured to attach to a second closure element for sealingly closing the second aperture, and a flange extending inward from the wall, the internal rim of the flange defining the perimeter of an opening in the second aperture, a second closure element comprises:

an outer skirt configured to enable the second closure element to attach to the second aperture of the container;

a flexible membrane;

a locating element comprising a shoulder having an edge separating two substantially orthogonal shoulder elements, wherein a first shoulder element is connected to the flexible membrane and a second shoulder element is connected to the outer skirt; and an inner skirt extending from the second shoulder element and spaced a distance from the edge, wherein the shoulder and inner skirt form an annular bounded ledge on which a seal can rest so as to span the space formed by the second shoulder element and the flexible membrane;

a seal configured to rest on the annular bounded ledge and to span the space formed by the second shoulder element and the flexible membrane, such that, in use with the second closure element attached to the container, the seal is configured to span across the opening in the second aperture;

wherein in use the container holds a first substance and the second closure element holds a second substance, and wherein the construction and arrangement of the second closure element is such that, in end use, the second substance is inserted into the second closure element and a seal located in place by the locating element such that when the second closure element is attached to the second aperture the seal is held sealingly in place to span the opening in the second aperture by the action of the locating element directly or indirectly bearing against the flange of the second aperture, such that when the flexible membrane is pushed the seal is ruptured causing the second substance within the second closure element to mix with the first substance in the container through the second aperture, and wherein said first aperture is configured to distribute the mixture.

10. A dispenser as claimed in claim 9 wherein the seal is a metal foil.

11. A dispenser as claimed in claim 10 wherein the metal foil forms a side of a blister pack.

12. A dispenser as claimed in claim 9 including a sealing element sufficient to ensure that, in use with the second closure element attached to the container, the second aperture is sealingly closable against leakage of the intended contents of the container.

13. A dispenser as claimed in claim 12 wherein the sealing element is an annulus of compressible sealing material.

14. A dispenser as claimed in claim 9 wherein the second aperture is substantially formed at the base of the container.

15. A dispenser as claimed in claim 9 wherein the second closure element is substantially in the form of a cup adapted to form the base of the dispenser and to shield the flexible diaphragm from inadvertent pressing.

16. A dispenser as claimed in claim 9 wherein only a peripheral annulus of the seal is engaged by the locating element.

17. A dispenser as claimed in claim 9 wherein the second closure element includes security element preventing the second closure element from being removed from said container once fully fitted.

18. A dispenser as claimed in claim 9 wherein the second closure element has a cylindrical skirt with a female thread adapted to mate with a corresponding male thread on the cylindrical wall forming part of the base of the container.

19. A dispenser as claimed in claim 18 wherein the cylindrical skirt and the cylindrical wall have mateable ramped teeth so that when threaded sufficiently together the respective teeth progressively mutually engage and prevent counter-rotation.

20. A dispenser as claimed in claim 18 wherein the cylindrical wall and the cylindrical skirt are welded or glued together when fully fitted.

21. A dispenser as claimed in claim 9 wherein the second substance is in the form of a solid tablet.

22. A dispenser as claimed in claim 9 wherein the second substance is contained in a blister pack.

23. A dispenser as claimed in claim 22 wherein only the side of the blister pack facing inwards is rupturable and the other side is flexible but not able to be ruptured by operation of the pressing element.

24. A dispenser as claimed in claim 23 wherein the inner facing side of the blister pack is a metal foil.

25. A dispenser as claimed in claim 9 wherein the first closure element and the first aperture and surrounding portion of the container are substantially identical to those of the second aperture and the second closure element.

26. A closure element as claimed in claim 1, wherein the flexible membrane is directly exposed to an exterior of the container for manual deflection.

* * * * *